US005122842A

United States Patent [19]

Rimai et al.

[11] Patent Number: 5,122,842

[45] Date of Patent: Jun. 16, 1992

[54] COLOR ELECTROSTATOGRAPHY PROCESS CONTROL BY WAY OF TONER DEVELOPMENT CHARACTERISTICS

[75] Inventors: Donald S. Rimai; John P. Spence, both of Webster, N.Y.

[73] Assignee: Eastman Kodak Company, Rochester, N.Y.

[21] Appl. No.: 636,823

[22] Filed: Jan. 2, 1991

[51] Int. Cl.[5] ..... G03G 15/01

[52] U.S. Cl. ..... 355/326; 355/208; 355/246; 430/43

[58] Field of Search ..... 355/245, 246, 326, 327, 355/328, 204, 208, 77; 118/645; 430/43

[56] References Cited

U.S. PATENT DOCUMENTS

| | | | |
|---|---|---|---|
| 4,806,980 | 2/1989 | Jamzadeh et al. | 355/208 |
| 4,935,779 | 6/1990 | Swada | 355/246 X |
| 4,943,834 | 7/1990 | Maeda et al. | 355/204 X |
| 4,970,536 | 11/1990 | Haneda et al. | 355/327 X |
| 4,987,453 | 1/1991 | Laukattis | 355/246 X |
| 4,989,043 | 1/1991 | Suzuki et al. | 355/246 |

*Primary Examiner*—R. L. Moses
*Assistant Examiner*—J. E. Barlow, Jr.
*Attorney, Agent, or Firm*—Milton S. Sales

[57] ABSTRACT

Information regarding a toner development characteristic associated with a development station is used to automatically adjust process control parameters associated with the other development stations to achieve quality color productions. A color electrostatographic image production device having a plurality of toner development stations, includes a toner development characteristic sensor at at least one of the development stations. A set of process control parameter control signals are produced for color separations produced by at least one other development station in response to the sensed development characteristic. Preferably, the toner development characteristic is the development rate of the development station or is a characteristic which influences the development rate of the development station.

12 Claims, 3 Drawing Sheets

$V_O$ CONTROLLER
30
$E_O$ CONTROLLER
36
LCU
24
20
M
34
28
48
50
18
B
Y
C
M
38
$V_B$ CONTROLLER
40
46

COLOR ELECTROSTATOGRAPHY PROCESS CONTROL BY WAY OF TONER DEVELOPMENT CHARACTERISTICS

CROSS-REFERENCE TO RELATED APPLICATIONS

Reference is made to commonly assigned, co-pending U.S. patent application Ser. No. 546,983 filed in the names of D. S. Rimai et al on Jul. 2, 1990.

BACKGROUND OF THE INVENTION

1. Technical Field

This invention relates generally to color copiers and printers, and more particularly to automatic adjustment of parameters influencing the output image color balance, color fidelity, and tone reproduction.

2. Background Art

In electrostatographic image production, several factors inhibit perfect and constant color reproduction in terms of color balance, color fidelity, and tone reproduction. These factors include, among others, variation in the toning contrast in the different color development stations.

Prior art systems attempt to diminish the adverse effects of these factors using either manual or automatic set up systems, or a combination of both. In typical manual set up systems, a skilled operator examines the output image and the corresponding input and output density ($D_{in}-D_{out}$) curves for red, green, blue, and black. Based on experience with the equipment, the operator determines adjustments to process control parameters, such as initial voltage $V_0$, exposure $E_0$, and development bias $V_b$. Several iterations of adjustment may be required to achieve acceptable color reproductions.

Automatic set up processes are known for adjusting one or more of the process control parameters affecting the output color and density. Such automatic adjustment is typically based on density measurements of toned test patches for each color separation. Whatever the set up procedure, good quality color reproductions can be made with a particular set up only so long as the toner development characteristics of each development station remains constant.

One factor which influences the development characteristics of a development station is the concentration of toner particles in the development mixture. Toner concentration monitors have been used for maintaining consistency in the toner concentration and/or for adjusting process control parameters based on the amount of toner particles in the mixture.

Other factors, such as mass, time, humidity, and charge ultimately affect the developed image. Therefore, commonly assigned, co-pending U.S. patent application Ser. No. 546,983 filed in the names of D. S. Rimai et al. on Jul. 2, 1990 now U.S. Pat. No. 5,006,897, discloses a toner development rate monitor for controlling process control parameters to give improved development performance.

A disadvantage to prior art systems is that they are adapted to control the process only for a particular development station and for the color separation associated with that particular development station. They are essentially feedback systems which endeavor to correct future images when a situation is detected in an earlier image production process.

DISCLOSURE OF INVENTION

Accordingly, it is an object of the present invention to use information regarding a toner development characteristic associated with a development station to automatically adjust process control parameters associated with the other development stations to achieve quality color productions.

It is still another object of the present invention to use information regarding a toner development rate associated with a development station to automatically adjust process control parameters associated with the other development stations to achieve quality color productions.

According to one aspect of the present invention, a color electrostatographic image production device having a plurality of toner development stations, includes means for sensing a toner development characteristic of at least one of the development stations, and means responsive to the sensed development characteristic of at least one of the development stations for producing a set of process control parameter control signals for color separations produced by at least one other development station. Preferably, the toner development characteristic is the development rate of the development station or is a characteristic which influences the development rate of the development station.

According to another aspect of the present invention, a color electrostatographic image production device having a plurality of toner development stations for producing a like plurality of color separations, includes means for calculating an error signal in accordance with a toner development characteristic of at least one of the development stations, means responsive to the error signal for calculating a set of process control parameter adjustment signals to minimize color production quality degradation, and means responsive to a set of parameter adjustment signals calculated from the development characteristic of at least one of the development stations for adjusting process control parameters for color separations produced by at least one other development station. Preferably, the toner development characteristic is the development rate of the development station or is a characteristic which influences the development rate of the development station.

According to yet another aspect of the present invention, a process, for automatically adjusting process control parameters in a color electrostatographic image production device having a plurality of toner development stations to achieve enhanced quality color productions, includes the steps of sensing a toner development characteristic of at least one of the development stations, and producing, in response to the sensed development characteristic of at least one of the development stations, a set of process control parameter control signals for color separations produced by at least one other development station. Preferably, the toner development characteristic is the development rate of the development station or is a characteristic which influences the development rate of the development station.

According to yet another aspect of the present invention, a process, for automatically adjusting process control parameters in a color electrostatographic image production device having a plurality of toner development stations capable of producing a like plurality of color separations to achieve enhanced quality color productions in terms of color balance, color fidelity, and tone production, includes the steps of calculating an error signal in accordance with a toner development characteristic of at least one of the development stations, calculating, in response to the error signal, a set of process control parameter adjustment signals to minimize color production quality degradation, and adjusting process control parameters for color separations produced by at least one development station other than the one development station in response to a set of parameter adjustment signals calculated from the development characteristic of at least one of the development stations. Preferably, the toner development characteristic is the development rate of the development station or is a characteristic which influences the development rate of the development station.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Electrostatographic Process

The present invention is described below in the environment of an electrophotographic printer. At the onset, it will be noted that although this invention is suitable for use with such machines, it also can be used with other types of electrostatographic printers, as well as with electrostatographic copiers.

For a detailed explanation of the theory of copier contrast and exposure control by controlling initial voltage $V_0$, exposure $E_0$, and development bias $V_b$, reference may be made to the following article: Paxton, Electrophotographic Systems Solid Area Response Model, 22 Photographic Science and Engineering 150 (May/June 1978).

Figure 1:
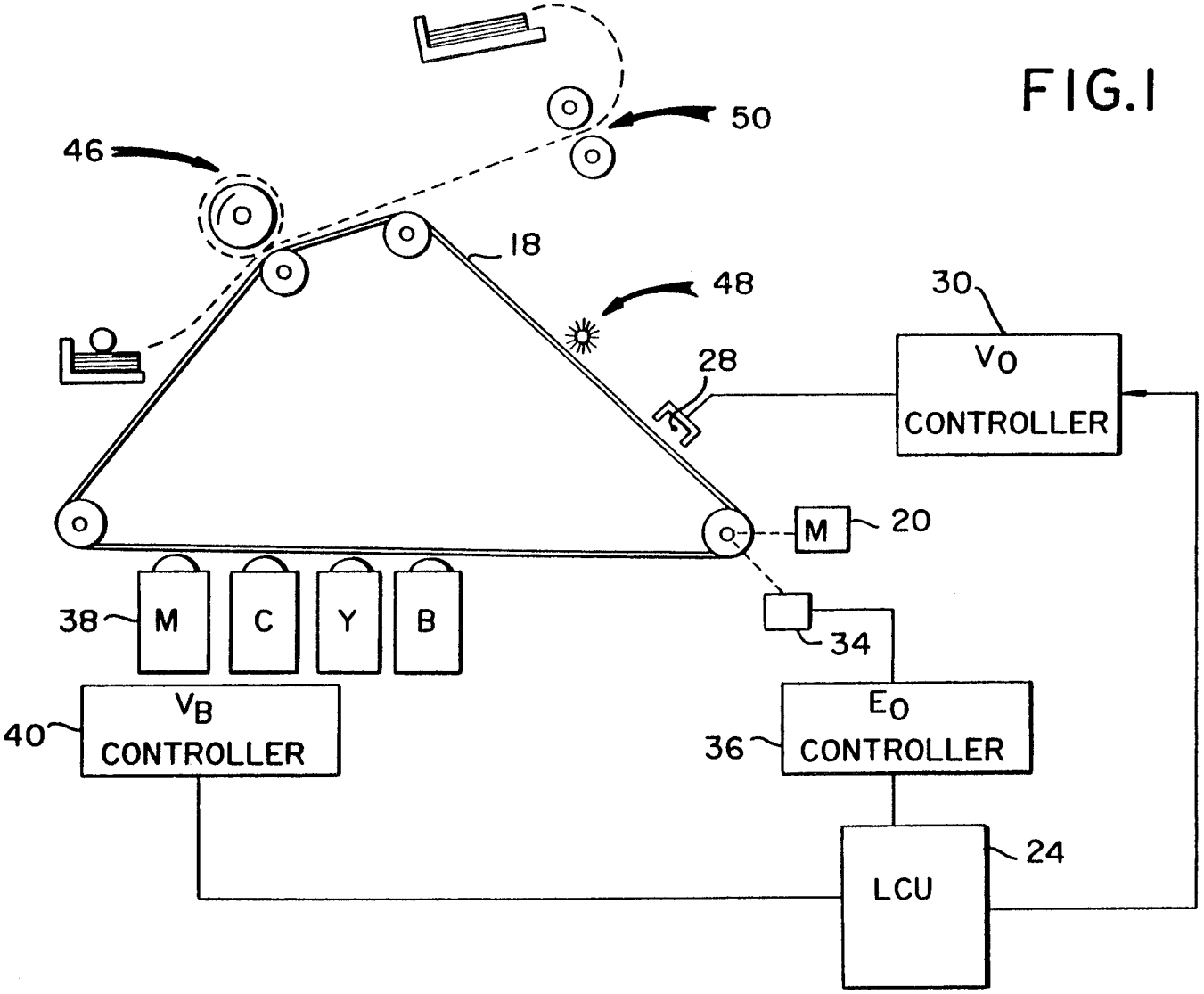
FIG. 1 is a schematic showing a side elevational view of an electrostatographic printer in which the present invention is useful.

Referring to FIG. 1, a moving transfer member such as photoconductive belt 18 is driven by a motor 20 past a series of work stations of the printer. A logic and control unit 24, which has a digital computer, has a stored program for sequentially actuating the work stations.

For a complete description of the work stations, see commonly assigned U.S. Pat. No. 3,914,046. Briefly, a charging station 28 sensitizes belt 18 by applying a uniform electrostatic charge of predetermined primary voltage $V_0$, to the surface of the belt which permits altering the contrast of the process. The output of the charger is regulated by a programmable controller 30, which is in turn controlled by logic and control unit 24 to adjust primary voltage $V_0$.

At an exposure station 34, projected light from a write head dissipates the electrostatic charge on the photoconductive belt to form a latent image of a document to be copied or printed. The write head preferably has an array of light-emitting diodes (LED's) or other light source for exposing the photoconductive belt picture element (pixel) by picture element with an intensity regulated by a programmable controller 36 as determined by logic and control unit 24. Alternatively, exposure may be by means of optical projection of light reflected from an original document.

Travel of belt 18 brings the areas bearing the latent charge images into a development region having plural, different-color toner development stations such as magenta development station 38. Each development station has a magnetic brush in juxtaposition to, but spaced from, the travel path of the belt. Magnetic brush development stations are well known. For example, see U.S. Pat. No. 4,473,029 to Fritz et al and U.S. Pat. No. 4,546,060 to Miskinis et al.

Logic and control unit 24 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes. The electrodes are connected to a variable supply of D.C. potential $V_b$ regulated by a programmable controller 40.

A transfer station 46 and a cleaning station 48 are both fully described in commonly assigned U.S. patent application Ser. No. 809,546, filed Dec. 16, 1985. After transfer of the unfixed toner images to a receiver sheet, such sheet is transported to a fuser station 50 where the image is fixed.

Logic and Control Unit

Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

Figure 2:
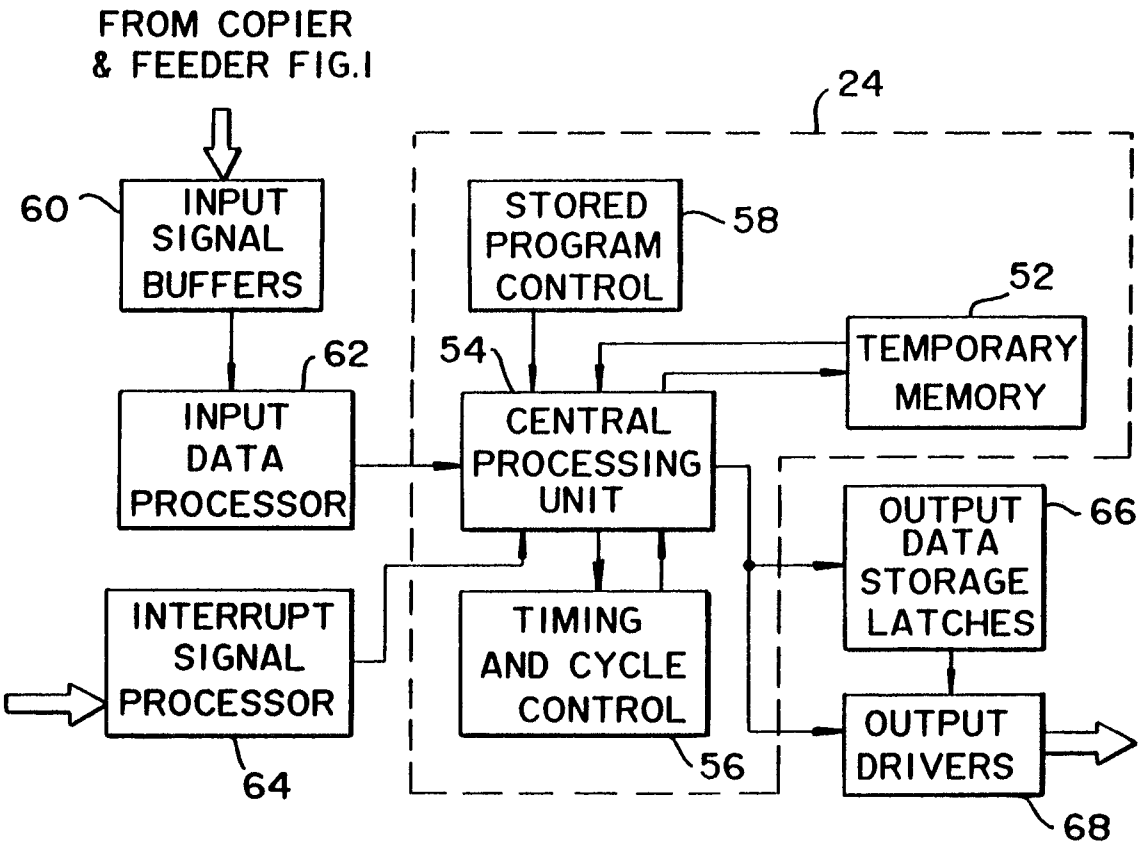
FIG. 2 is a block diagram of the logic and control unit shown in FIG. 1.

Referring to FIG. 2, a block diagram of a typical logic and control unit 24 is shown. The logic and control unit consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Feed Forward Control

Process control strategies according to the present invention utilize sensors which measure the toner development rate (or a toner characteristic which influences the development rate) of at least one of the development stations during the development of one or more color separations to provide real-time control of the electrostatographic process during the production of subsequent color separations which form the composite image such that quality color productions from the user's perspective are achieved.

Toner characteristics which influence development rate may include not only the concentration of the toner mixture, but also other factors such as the charge-to-mass ratio of the toner particles, the charge distribution, and the presence of wrong-sign particles. Other factors, such as mass, time, humidity, and charge, ultimately affect the developed image.

Figure 3:
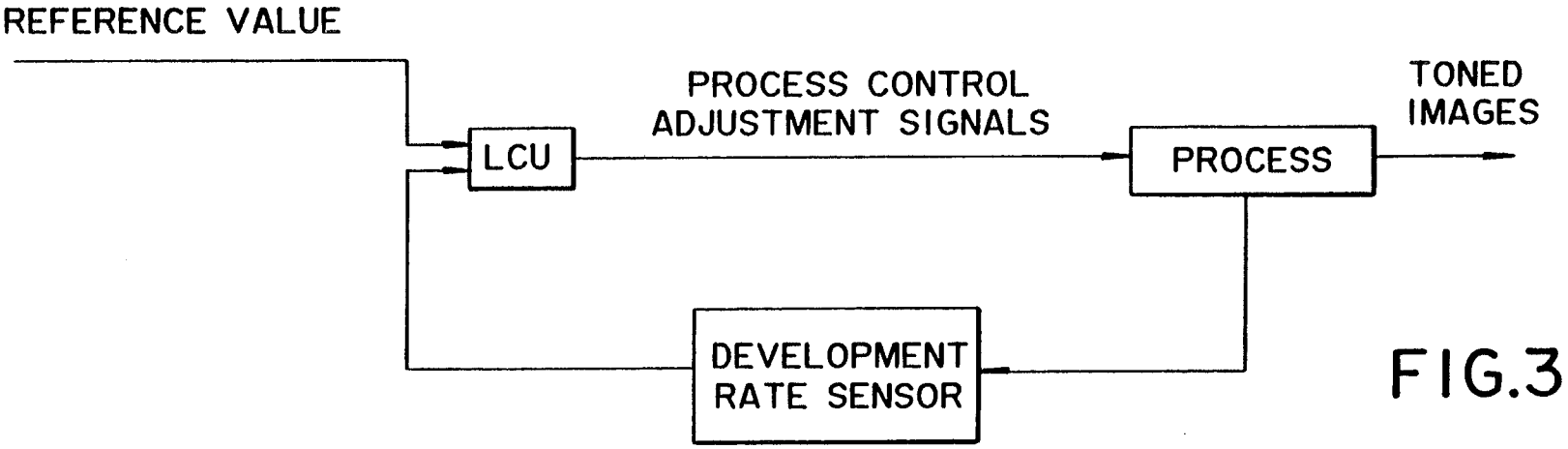
FIG. 3 is a block diagram of the system for effecting the color quality improvements in accordance with the present invention.

Referring to FIG. 3, logic and control unit 24 receives signals from sensors which measure the toner development rate (or a toner characteristic which influences the development rate) of at least one of the development stations during the development of one or more color separations and compares the signal to a reference signal indicative of ideal values for each development station. Logic and control unit 24 determines the error between the actual measured values and reference values, and calculates process control parameter adjustment signals to be applied during the production of subsequent color separations of the composite image such as to achieve enhanced quality color productions.

Figure 4:
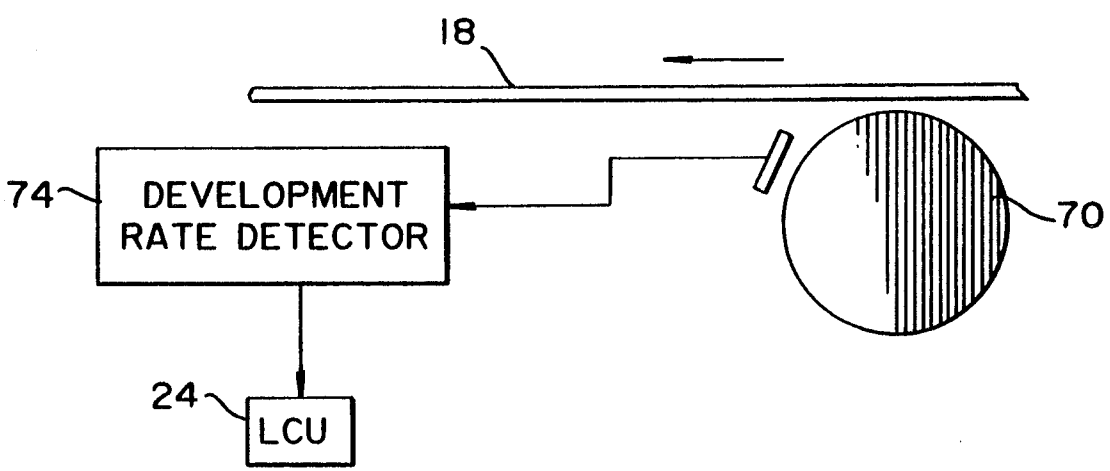
FIG. 4 is an enlarged portion of the schematic of FIG. 1.

A sensor for measuring the toner development rate is shown in FIG. 4. A toning brush or roller 70 carries developer mixture to photoconductive belt 18 for the purpose of developing a latent image on the belt. A plate or electrode 72 is positioned adjacent to brush 70. This electrode forms a capacitor with the brush. One electrical connection is made between the electrode and a development rate detector 74, and a second electrical connection is made between the brush and the detector. This electrical circuit includes the equivalent of a capacitor having one plate as plate 72 and the other plate as brush 70, with the developer mixture positioned between the two plates and acting as part of the dielectric of the capacitor. By measuring and monitoring the electrical characteristics of the capacitive circuit, development rate detector 74 can issue appropriate signals to logic and control unit 24. Additional disclosure and details of detector 74 can be found in above-mentioned U.S. patent application Ser. No. 546,983, the disclosure of which is hereby specifically incorporated herein. Because the monitoring system disclosed in FIG. 4 is responsive to the actual amount of toner deposited on a capacitor electrode, a true indication of the development rate is achieved irrespective of other factors which influence development rate.

The invention has been described in detail with particular reference to preferred embodiments thereof, but it will be understood that variations and modifications can be effected within the spirit and scope of the invention.

What is claimed is:

1. In a color electrostatographic image production device having a plurality of toner development stations to form a composite color image by overlaying a plurality of color separations, apparatus for automatically adjusting process control parameters to achieve enhanced quality color productions; said apparatus comprising:

means for sensing a toner development characteristic of at least one of said development stations during production of one color separation of a composite image; and means responsive to the sensed development characteristic of said at least one development station for producing a set of process control parameter control signals for color separations subsequently produced by at least one other development station for the same composite color image.

2. Apparatus as defined in claim 1 wherein said toner development characteristic is the development rate of the development station.

3. Apparatus as defined in claim 1 wherein said toner development characteristic is a characteristic which influences the development rate of the development station.

4. In a color electrostatographic image production device having a plurality of toner development stations for producing a composite color image by overlaying a like plurality of color separations, apparatus for automatically adjusting process control parameters to achieve enhanced quality color productions in terms of color balance, color fidelity, and tone production; said apparatus comprising:

means for calculating an error signal in accordance with a toner development characteristic of at least one of said development stations during production of one color separation of a composite color image;

means responsive to said error signal for calculating a set of process control parameter adjustment signals to minimize color production quality degradation; and means responsive to a set of parameter adjustment signals calculated from the development characteristic of said at least one of said development stations for adjusting process control parameters for color separations subsequently produced by at least one of the remaining development stations other than said one development station for the same composite color image.

5. Apparatus as defined in claim 4 wherein said toner development characteristic is the development rate of the development station.

6. Apparatus as defined in claim 4 wherein said toner development characteristic is a characteristic which influences the development rate of the development station.

7. A process for automatically adjusting process control parameters in a color electrostatographic image production device having a plurality of toner development stations to form a composite color image by overlaying a plurality of color separations to achieve enhanced quality color productions; said process comprising the steps of:

sensing a toner development characteristic of at least one of said development stations during production of one color separation of a composite color image; and producing, in response to the sensed development characteristic of said at least one development station, a set of process control parameter control signals for color separations subsequently produced by at least one other development station for the same composite color image.

8. A process as defined in claim 7 wherein said toner development characteristic is the development rate of the development station.

9. A process as defined in claim 7 wherein said toner development characteristic is a characteristic which influences the development rate of the development station.

10. A process for automatically adjusting process control parameters in a color electrostatographic image production device having a plurality of toner development stations capable of producing composite color images by overlaying a like plurality of color separations to achieve enhanced quality color productions in terms of color balance, color fidelity, and tone production: said process comprising the steps of:

calculating an error signal in accordance with a toner development characteristic of at least one of said development stations during production of one color separation of a composite color image;

calculating, in response to said error signal, a set of process control parameter adjustment signals to minimize color production quality degradation; and adjusting process control parameters for color separations subsequently produced for the same composite color image by at least one development station other than said one development station in response to a set of parameter adjustment signals calculated from the development characteristic of said at least one of said development stations.

11. A process as defined in claim 10 wherein said toner development characteristic is the development rate of the development station.

12. A process as defined in claim 10 wherein said toner development characteristic is a characteristic which influences the development rate of the development station.

* * * * *